US007896171B2

(12) United States Patent
Battaglia

(10) Patent No.: US 7,896,171 B2
(45) Date of Patent: Mar. 1, 2011

(54) GRAVITY FEED SHELVING APPARATUS AND METHODS

(75) Inventor: Joseph M. Battaglia, Frisco, TX (US)

(73) Assignee: Universal Display & Fixtures Company, Lewisville, TX (US)

( * ) Notice: Subject to any disclaimer, the term of this patent is extended or adjusted under 35 U.S.C. 154(b) by 557 days.

(21) Appl. No.: 11/951,873

(22) Filed: Dec. 6, 2007

(65) Prior Publication Data

US 2009/0145869 A1 Jun. 11, 2009

(51) Int. Cl.
*A47F 1/04* (2006.01)

(52) U.S. Cl. ..... 211/59.2; 211/133.5; 211/184; 211/106

(58) Field of Classification Search ..... 211/59.2, 211/103, 106, 190, 207, 181.1, 90.01–90.04, 211/87.01, 184, 59.3, 85.31, 126.8, 126.9, 211/133.2, 133.5; 312/35
See application file for complete search history.

(56) References Cited

U.S. PATENT DOCUMENTS 2,971,668 A * 2/1961 Peglow ..... 220/488
3,608,741 A * 9/1971 Schray ..... 211/184
3,929,248 A * 12/1975 Morrison ..... 220/486
4,023,682 A * 5/1977 Niece ..... 211/184
4,331,243 A * 5/1982 Doll ..... 211/59.2
5,464,105 A * 11/1995 Mandeltort ..... 211/184
6,273,276 B1 * 8/2001 Upton et al. ..... 211/59.2
6,299,004 B1 * 10/2001 Thalenfeld et al. ..... 211/184
7,140,705 B2 * 11/2006 Dressendorfer et al. .. 312/348.3
7,743,932 B2 * 6/2010 Lynch ..... 211/184
2001/0047968 A1 * 12/2001 Wright ..... 211/41.3
2003/0146177 A1 * 8/2003 Miller et al. ..... 211/59.2
2003/0189018 A1 * 10/2003 Hopkins et al. ..... 211/90.02
2004/0020878 A1 * 2/2004 Boron ..... 211/59.2
2004/0065631 A1 * 4/2004 Nagel ..... 211/59.3
2004/0256341 A1 * 12/2004 Donnell et al. ..... 211/187
2005/0161418 A1 * 7/2005 Lynch ..... 211/119.003
2006/0096938 A1 * 5/2006 Kanou ..... 211/184
2006/0113262 A1 * 6/2006 Knorring et al. ..... 211/59.2
2007/0295681 A1 * 12/2007 Colin ..... 211/90.03

* cited by examiner

*Primary Examiner*—Jenifer E. Novosad
(74) *Attorney, Agent, or Firm*—Haynes and Boone, LLP

(57) ABSTRACT

A gravity feed shelving system is provided in which specially configured tiers contain necked-down channels for the receiving, storing and dispensing of series of flexible packages such as flex bags. Each channel is configured with relatively wide receiving and dispensing portions at the rear and front of the tier, respectively, and a narrowed intermediate portion that partially compresses the flex bags and restrains them against their removal from the channel until the flex bag passes from the intermediate portion into the dispensing portion. The tier has an operatively sloped orientation so that, once placed within the receiving portion of the channel, each flex bag is urged along the channel and into the intermediate portion by the force of its own weight.

29 Claims, 10 Drawing Sheets

GRAVITY FEED SHELVING APPARATUS AND METHODS

BACKGROUND

The present disclosure relates in general to inventory management systems and in particular to gravity feed shelving for displaying and dispensing stock contained in flexible packaging.

DETAILED DESCRIPTION

Figure 1:
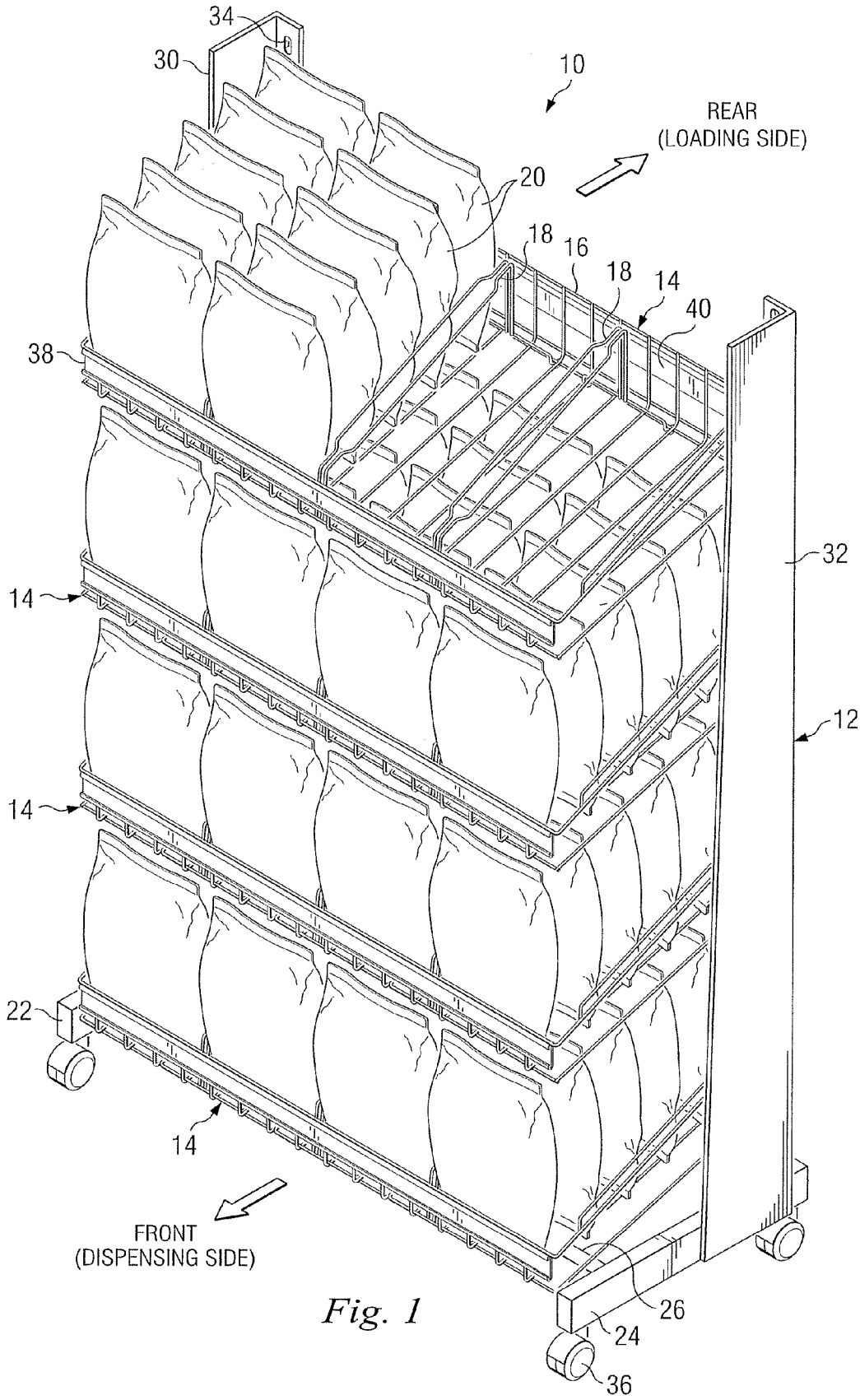
FIG. 1 is a perspective view of a specially designed gravity feed shelving apparatus embodying principles of the present invention and showing some of the display items operationally supported thereon.

Referring to FIG. 1, a gravity feed system embodying principles of the present invention is referred to, in general, by the reference numeral 10. The gravity feed system 10 includes a support structure 12 to which a multitude of tiers 14 are removably coupled. The tiers 14 include a base unit 16 and a multitude of novel dividers 18 that create adjustably sized spaces for the organized display and dispensing of products packaged in flex bags 20 or other variably shaped flexible containers.

The support structure 12 is representatively illustrated in FIG. 1 as including a first pair of horizontally extending, spaced parallel members 22 and 24 connected by a first horizontally extending member 26 and a second, spaced, corresponding member (not shown), both of which run between and perpendicular to the members 22 and 24. Secured to and extending upward from the members 22 and 24 are a pair of uprights 30 and 32, respectively, each having a generally L-shaped cross-section along its length. The rear side portion of each of the uprights 30 and 32 includes a series of vertically spaced holes 34 by which the tiers 14 may be attached to the support structure 12. Although the support structure 12 is shown in FIG. 1 as including dual-disc casters 36, the support structure 12 can alternatively include any type of caster, glide, or other mechanical feature that enables the support structure 12 to be rotated so that the rear of the support structure 12 is accessible.

Figure 2:
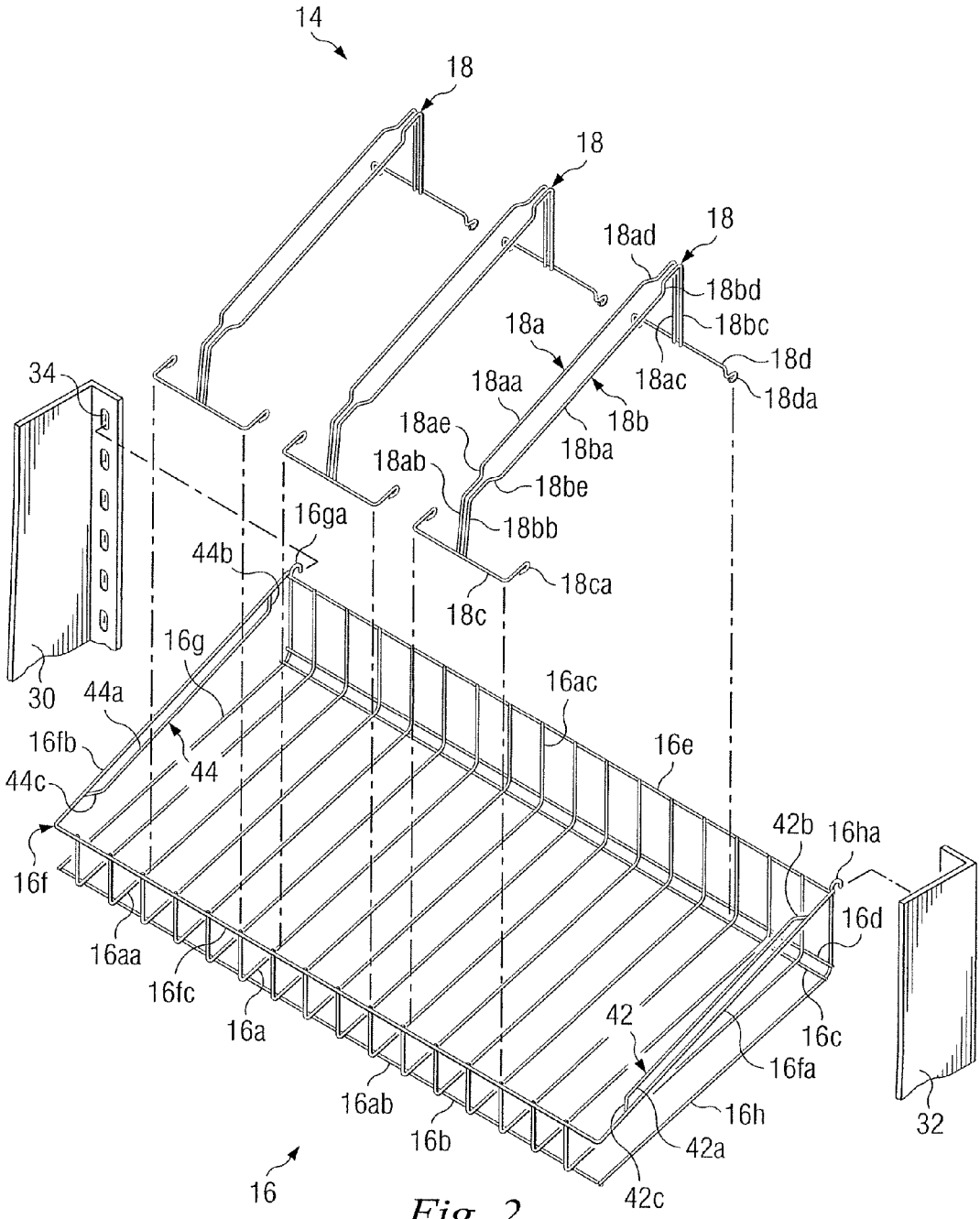
FIG. 2 is an exploded perspective view of one of the tiers shown in FIG. 1.

Referring to FIG. 2, the base unit 16 is representatively illustrated as comprising a multitude of generally U-shaped wire members 16*a* that provide the framework of the base unit 16. Each of the wire members 16*a* comprises a sloping section 16*aa* that joins a generally vertical front section 16*ab* and a generally vertical rear section 16*ac*. The wire members 16*a* are connected and secured at the front and rear of the base unit 16 by front support member 16*b* and rear support members 16*c*, 16*d*, and 16*e*, all of which extend horizontally and perpendicular to the wire members 16*a*. The wire members 16*a* are also joined by a top support member 16*f*, which includes side portions 16*fa* and 16*fb* which extend generally from the ends of the support member 16*e* and front portion 16*fc* that follows the top edges of the sides and front of the base unit 16. Support members 16*g* and 16*h* extend generally perpendicular to and join the support members 16*b*, 16*c*, 16*d*, and 16*e* at the bottom and rear edges of the ends of the base unit 16 and include protrusions 16*ga* and 16*ha*, respectively, which are generally hook-shaped and extend upward and to the rear of the base unit 16.

When the base unit 16 is in an assembled condition and is oriented so that the front sections 16*ab* and the rear sections 16*ac* are generally vertical, as illustrated in FIGS. 1 and 2, the sloping sections 16*aa* define a plane that slopes downward from the rear of the base unit 16. As is described herein, this downward slope facilitates operation of the gravity feed system 10.

In some exemplary embodiments in which the base unit 16 is configured for use in conjunction with the dividers 18 the base unit 16 includes a retaining member 42 and a retaining member 44. The retaining members 42 and 44 extend generally toward each other from the side portions 16*fa* and 16*fb* of the top support member 16*f*, respectively. The retaining member 42 comprises three linear, coplanar sections: a retaining section 42*a* and bevels 42*b* and 42*c*. The end sections 42*b* and 42*c* extend from the retaining section 42*a* and toward the side portion 16*fa*. In some exemplary embodiments, the end sections 42*b* and 42*c* extend in such directions as to create substantially identical obtuse angles with the retaining section 42*a*. In other exemplary embodiments, the bevels 42*b* and 42*c* extend from the retaining section 42*a* at different angles and are not obtuse with the retaining section 42*a*.

In some exemplary embodiments, such as that illustrated in FIG. 2, the retaining member 42 is attached to the side portion 16*fa* at the free ends of the bevels 42*b* and 42*c* so that the retaining section 42*a* is extended out over the interior space of the base unit 16 substantially in parallel with a plane defined by the bottom of the base unit 16. The retaining section 42*a* also runs substantially in parallel with the side portion 16*fa*.

The structure of the retaining member 44 and the interaction of its retaining section 44*a* and bevels 44*b* and 44*c* with the side portion 16*fb* are substantially similar to that of the retaining member 42 and its components with the side portion 16*fa* and are not described in detail herein.

In some exemplary embodiments, such as that illustrated in FIG. 1, barcode holders 38 and 40 can be affixed to the front and rear of the base unit 16. In other exemplary embodiments, as shown in FIG. 2, one or both of the barcode holders 38 and 40 can be omitted from the gravity feed system 10.

One skilled in the art will appreciate that the base unit 16 can be constructed using any of a variety of materials and methods suitable for producing an apparatus for supporting retail inventory. For example, a variety of wire gauges can be used for the base unit 16, and the bottom and vertical sections of the base unit 16 can comprise solid panels, rather than wire.

In some exemplary embodiments, the base units 16 and the retaining members 42 and 44 may be powder-coated or otherwise treated with a friction-reducing product so as to facilitate the movement of flex bags 20 within the tier 14 (as later described herein). Such products may contain, for example, Teflon or other materials with similar low-friction properties. One example of such material is the Sliptex powder coating manufactured by Prism Powder Coating Ltd. However, other materials are also within the scope of the present disclosure.

Figure 3:
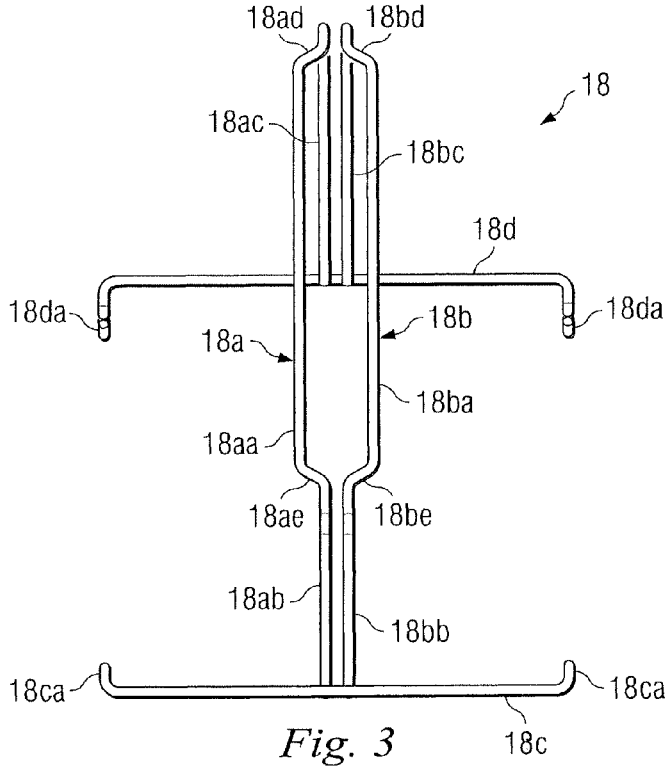
FIG. 3 is a front elevational view of one of the dividers shown in FIG. 2.
Figure 4:
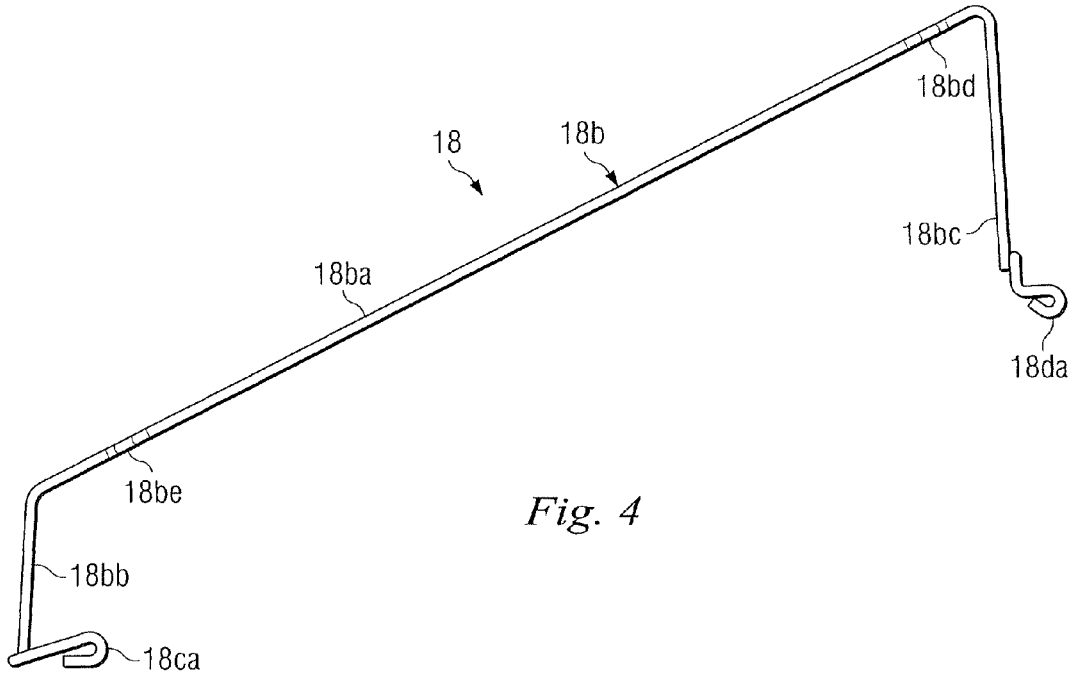
FIG. 4 is a side elevational view of one of the dividers shown FIG. 2.
Figure 5:
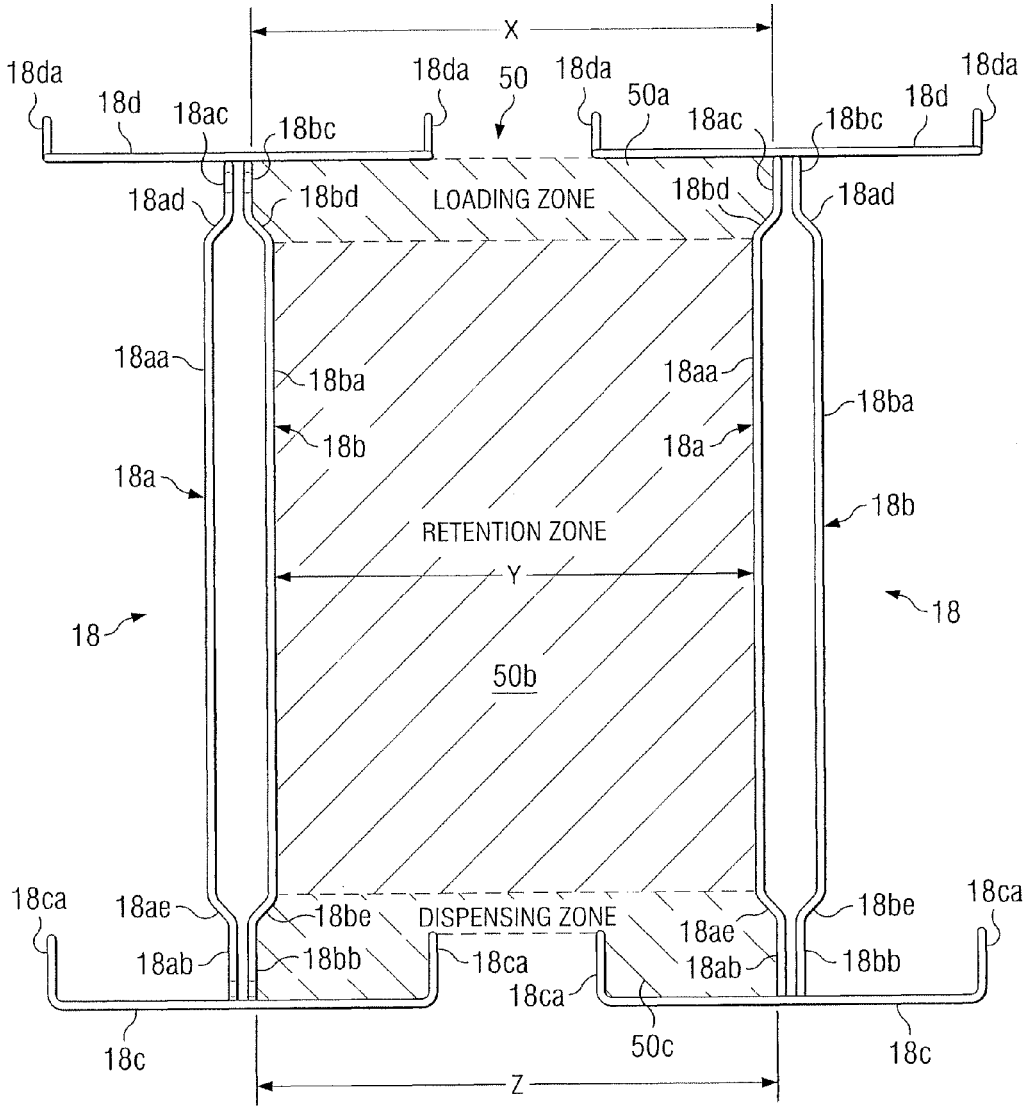
FIG. 5 is a top plan view of a properly oriented pair of the dividers shown in FIG. 2.

A representative divider 18 is illustrated in FIGS. 3-5 as including a spaced pair of dividing members 18*a* and 18*b* comprising sloping sections 18*aa* and 18*ba*, generally vertical front sections 18*ab* and 18*bb* and generally vertical rear sections 18*ac* and 18*bc*, respectively. The spacing between the dividing members 18*a* and 18*b* is generally greater along the sloping sections 18*aa* and 18*ba* than along the front sections 18*ab* and 18*bb* and the rear sections 18*ac* and 18*bc*.

Figure 7:
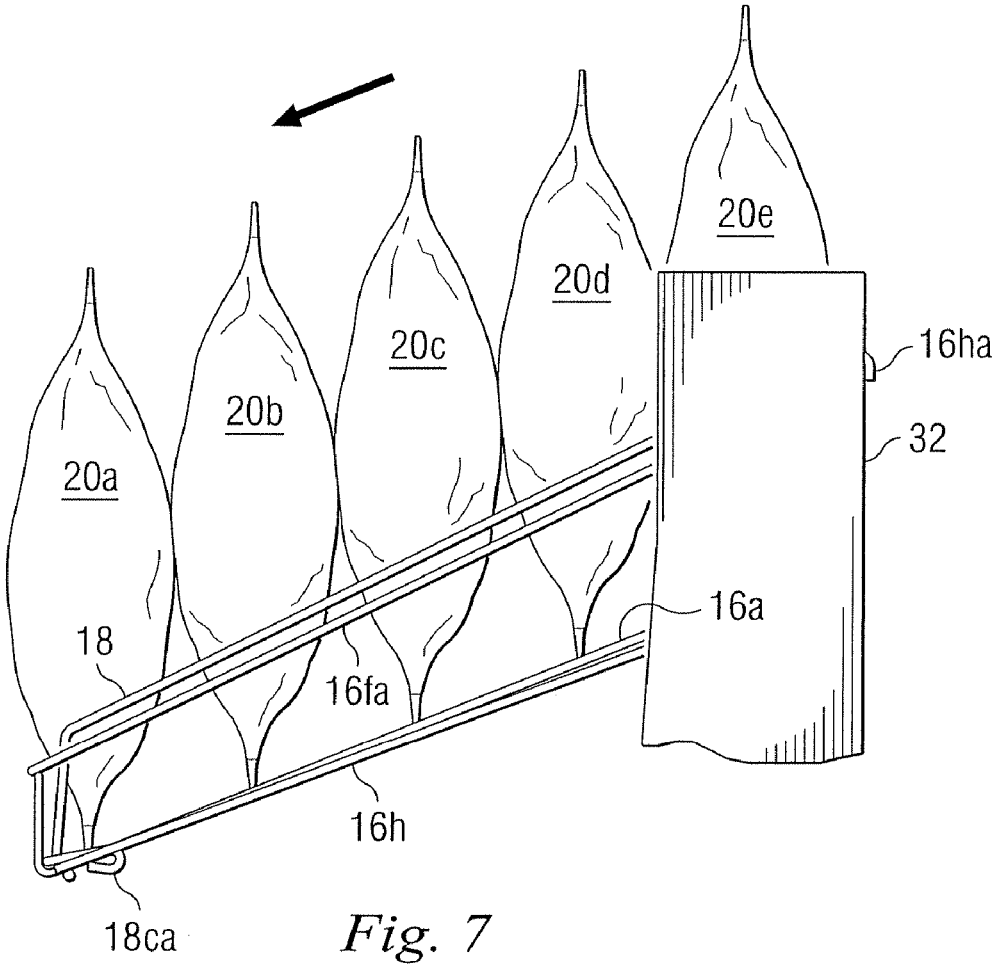
FIG. 7 is a side elevational view of the tier illustrated in FIG. 6.
Figure 9:
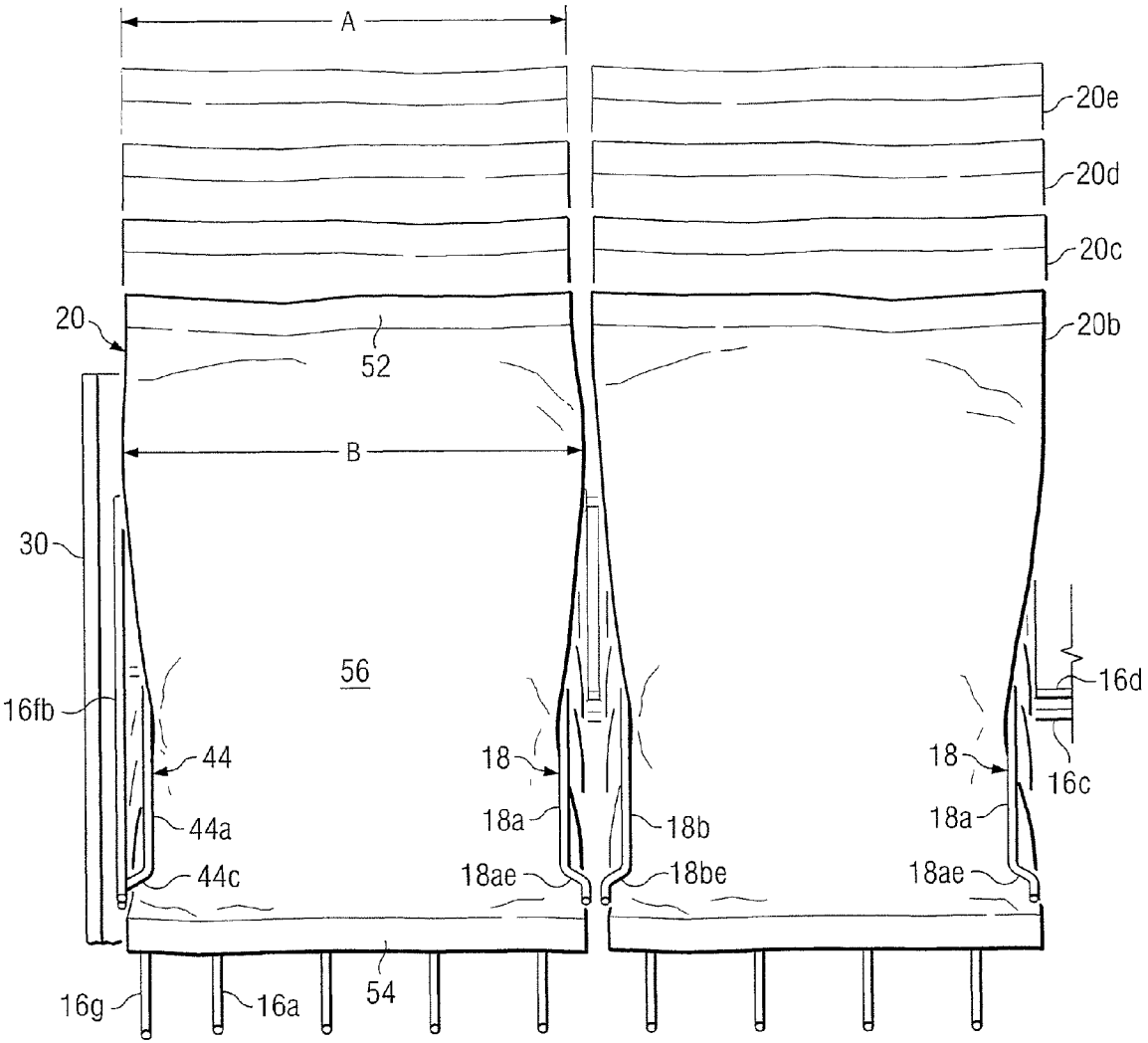
FIG. 9 is a cross-sectional view of a portion the tier illustrated in FIGS. 8, taken along Line 9-9 thereof.

As shown in FIGS. 7 and 9, the narrowing of the space between the dividing members 18*a* and 18*b* toward the ends of the sloping sections 18*aa* and 18*ba* creates two sets of opposing bevels: rear bevels 18*ad* and 18*bd* (see FIG. 3) and front bevels 18*ae* and 18*be*. In some exemplary embodiments, the bevels 18*ad* and 18*ae* and the bevels 18*bd* and 18*be* form identical obtuse angles with the sloping portions 18*aa* and 18*bb*, respectively. In other exemplary embodiments, the bevels 18*ad* and 18*ae* and the bevels 18*bd* and 18*be* extend at non-identical angles from the sloping portions 18*aa* and 18*ba*, respectively, and do not form obtuse angles with the sloping portions 18*aa* and 18*ba*, respectively.

The sloping sections 18*aa* and 18*ba* extend beyond the bevels 18*ad* and 18*ae* and the bevels 18*bd* and 18*be*, respectively. The sloping sections 18*aa* and 18*ba* then meet the front sections 18*ab* and 18*bb*, respectively, and the rear sections 18*ac* and 18*bc*, respectively.

In some exemplary embodiments, the free ends of the front sections 18*ab* and 18*bb* and the rear sections 18*ac* and 18*bc* are connected to a front divider base 18*c* and a rear divider base 18*d*, respectively, both of which extend horizontally and substantially perpendicular to the dividing members 18*a* and 18*b*. The ends of the front divider base 18*c* each include a protrusion 18*ca* that extends first rearward and then downward. The ends of the rear divider base 18*d* each include a protrusion 18*da* that extends first downward and then rearward. As is described in further detail below, the length of the divider bases 18*c* and 18*d* are determined, to a certain extent, by the distance between adjacent wire members 16*a*. In some exemplary embodiments, the length of the divider bases 18*c* and 18*d* is either slightly less than or slightly greater than the distance between a set number of the wire members 16*a*.

In some exemplary embodiments, the overall horizontal length of the divider 18 is dictated by the dimensions of the base unit 16 and the ability of the divider 18 to fit properly within the base unit 16 once installed. In other exemplary embodiments, other dimensions and properties of the divider 18 such as, for example, the length of the bevels 18*ad* and 18*ae* and the bevels 18*bd* and 18*be* and their angles relative to the sloping sections 18*aa* and 18*bb*, respectively, the degree of downward slope along the sloping sections 18*aa* and 18*bb*, and the length of the front sections 18*ab* and 18*bb* and the rear sections 18*ac* and 18*bc* are dictated by the dimensions and properties of the flex bags 20 or other containers that will be displayed in and dispensed from the gravity feed system 10. As described below, the tailoring of the components of the divider 18 to suit the relevant inventory facilitates operation of the gravity feed system 10. In some exemplary embodiments, the dimensions and properties of the components of the retaining members 42 and 44 correspond to the dimensions and properties of the dividers 18 that are installed in the base unit 16. In some such embodiments, the retaining members 42 and 44 extend from the members 16*fa* and 16*fb*, respectively, at an angle such that the height of the retaining members 42 and 44 approximate the height of the dividers 18 that are installed in the tier 14.

One skilled in the art will appreciate that the divider 18 can be constructed using any of a variety of materials and methods suitable for separating and guiding the movement of flex bag inventory. For example, a variety of wire gauges can be used for the divider 18, and the dividing members 18*a* and 18*b* can be shaped from a solid member, rather than two spaced members.

In some exemplary embodiments, the dividers 18 may be powder-coated or otherwise treated with a friction-reducing product so as to facilitate the movement of flex bags 20 when they are in contact with the dividing members 18*a* or 18*b*. Such products may contain, for example, Teflon or materials with similar low-friction properties. One example of such material is the Sliptex powder coating manufactured by Prism Powder Coating Ltd. However, other materials are also within the scope of the present disclosure.

Figure 6:
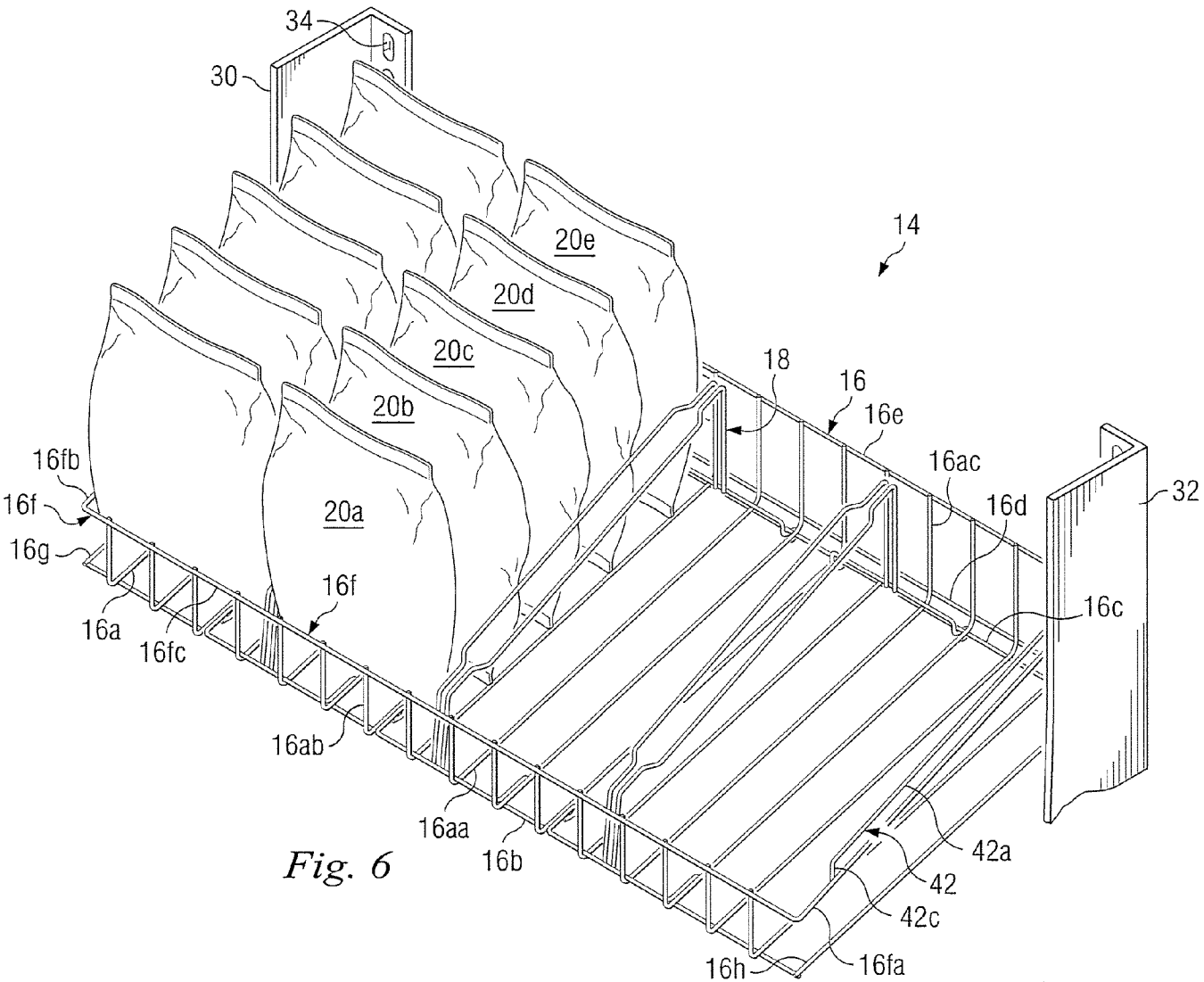
FIG. 6 is an enlarged scale perspective view of a partially stocked tier of the gravity feed shelving apparatus illustrated in FIG. 1.

Referring back to FIG. 6, each divider 18 is installed in the base unit 16 by first inserting the rear of the divider 18 into the interior space of the base unit 16, as defined by the wire members 16*a*, and hooking the protrusions 18*da* under the rear support member 16*c*. The divider 18 is then pivoted about the rear support member 16*c* so that the front of the divider 18 is lowered into the space defined by the wire members 16*a* until either the front divider base 18*c* rests on the wire members 16*a* or the protrusions 18*ca* rest on the front support member 16*b* (depending on the specific dimensions of the base unit 16 and the divider 18). Removal of each divider 18 is accomplished by raising the front of the divider 18 so that the front divider base 18*c* clears the top support member 16*f* then unhooking the protrusions 18*da* from under the rear support member 16*c* and lifting the divider 18 clear of the base unit 16.

As is described in further detail herein, the appropriate spacing of multiple dividers 18 within the base unit 16 is determined by the properties of each item to be displayed and the total number of items to be displayed on each tier 14. In some exemplary embodiments, the divider 18 is configured such that the divider bases 18*c* and 18*d* straddle the same wire members 16*a* and the positions of the protrusions 18*ca* and 18*da* with respect to those wire members 16*a* are similar. In some such embodiments (e.g., FIG. 6), the dividers 18 that are installed as described above are positioned so that the protrusions 18*ca* and 18*da* of the divider bases 18*c* and 18*d*, respectively, are immediately adjacent wire members 16*a* and are all either inside or outside of such wire members 16*a*, with respect to the location of the dividing members 18*a* and 18*b*, so that lateral movement of the divider 18 is restricted.

In some exemplary embodiments, the dimensions of the base unit 16 and the divider 18 will allow for clearance between the front divider base 18*c* and the front portion 16*fc* of the top support member 16*f*. In other embodiments, the dimensions of the base unit 16 and the divider 18 will create a snap-fit wherein force must be applied to the front divider base 18*c* in order to advance it past the front portion 16*fc*, in which case the front portion 16*fc* then acts to retain the divider 18 within the base unit 16.

Referring to FIG. 5, an overhead view of a pair of the dividers 18 demonstrates the spatial relationship between the dividers 18 when they are oriented and located with respect to each other as they would be when installed in the base unit 16. For purposes of clarity, each of the dividers 18 is additionally described, within the context of FIG. 5 only, as being either directionally "left" or "right" of the other divider 18. As depicted in FIG. 5, a channel 50 is substantially defined by, and includes the space directly between, the dividing member

18*b* of the left divider 18 and the dividing member 18*a* of the right divider 18. A loading zone 50*a* comprises the portion of the channel 50 that extends from the rearward-most end of the channel 50 to a boundary defined by the forward-most ends of the opposing bevels 18*bd* and 18*ad*. A retention zone 50*b* comprises the portion of the channel 50 that extends from the forward-most boundary of the loading zone 50*a* to the rearward-most ends of the opposing bevels 18*be* of the left divider 18 and 18*ae* of the right divider 18. A dispensing zone 50*c* comprises the portion of the channel 50 that extends from the forward-most boundary of the retaining zone 50*b* to the forward-most end of the channel 50.

The loading zone 50*a* has a width X that corresponds to the distance between the rear vertical portion 18*bd* of the left divider 18 and the rear vertical portion 18*ad* of the right divider 18. The retention zone 50*b* has a width Y that corresponds to the distance between the sloping portion 18*bb* of the left divider 18 and the sloping portion 18*ab* of the right divider 18. The dispensing zone 50*c* has a width Z that corresponds to the distance between the front vertical portion 18*bb* of the left divider 18 and the front vertical portion 18*ab* of the right divider 18. The widths X, Y and Z are determined by the spacing of the dividers 18 as installed into the base unit 16. In some exemplary embodiments, the divider 18 is configured so that the widths X and Z are substantially similar and the widths X, Y and Z remain constant throughout the loading zone 50*a*, the retention zone 50*b* and the dispensing zone 50*c*, respectively. In other exemplary embodiments, the divider 18 is configured such that the widths X and Z are different and the widths X, Y and Z vary along the lengths of the loading zone 50*a*, the retention zone 50*b* and the dispensing zone 50*c*, respectively.

In some exemplary embodiments, the channel 50 and the dimensional features associated therewith (described above) are similarly defined by the comparable spatial relationship between either of the retaining members 42 and 44—in conjunction with the top support member 16*f*—and an adjacent divider 18.

As referenced previously herein, the shape of the dividers 18 and the retaining sections 42 and 44, as well as the placement and spacing of the dividers 18 with respect to one another and the retaining sections 42 and 44, is based on the physical properties of the flex bags 20. Referring to FIG. 9, the flex bags 20 each comprise a top 52, a base 54, and a body 56. The top 52 and the base 54 are substantially defined by flattened tabs that constitute seams of the flex bag 20 and generally have a width A. The body 56 comprises the voluminous portion of the flex bag 20 which contains foodstuffs or other goods and has an uncompressed width B.

In some exemplary embodiments, the channel 50 is formed by the placement of two dividers 18—or one of the dividers 18 and one of the retaining members 42 and 44, as describe above—so that the widths X and Z of the loading zone 50*a* and the dispensing zone 50*c*, respectively, are approximately equal to or less than the width A of the base 54. In some such embodiments, the width Y of the retaining zone 50*b* is consistent and is both no greater than the width B of the body 20*b* and no less than a width that allows for the flex bag 20 to move easily along the channel 50.

As described previously herein, when the tier 14 is in an assembled condition and is installed on the support structure 12, the base unit 16 is oriented so that the sections 16*ab* and 16*ac* are generally vertical, as illustrated in FIGS. 1 and 2, and the sloping sections 16*aa* define a plane that slopes downward toward the front of the base unit 16. The angle of the downward slope of the base unit 16 is varied—by either the construction of the base unit 16 or the angle at which it is coupled with the support structure 12—based on the properties of the inventory being stored on and dispensed from the tier 14 so that the flex bags 20 can be gravity fed toward the front of the tier 14.

Figure 8:
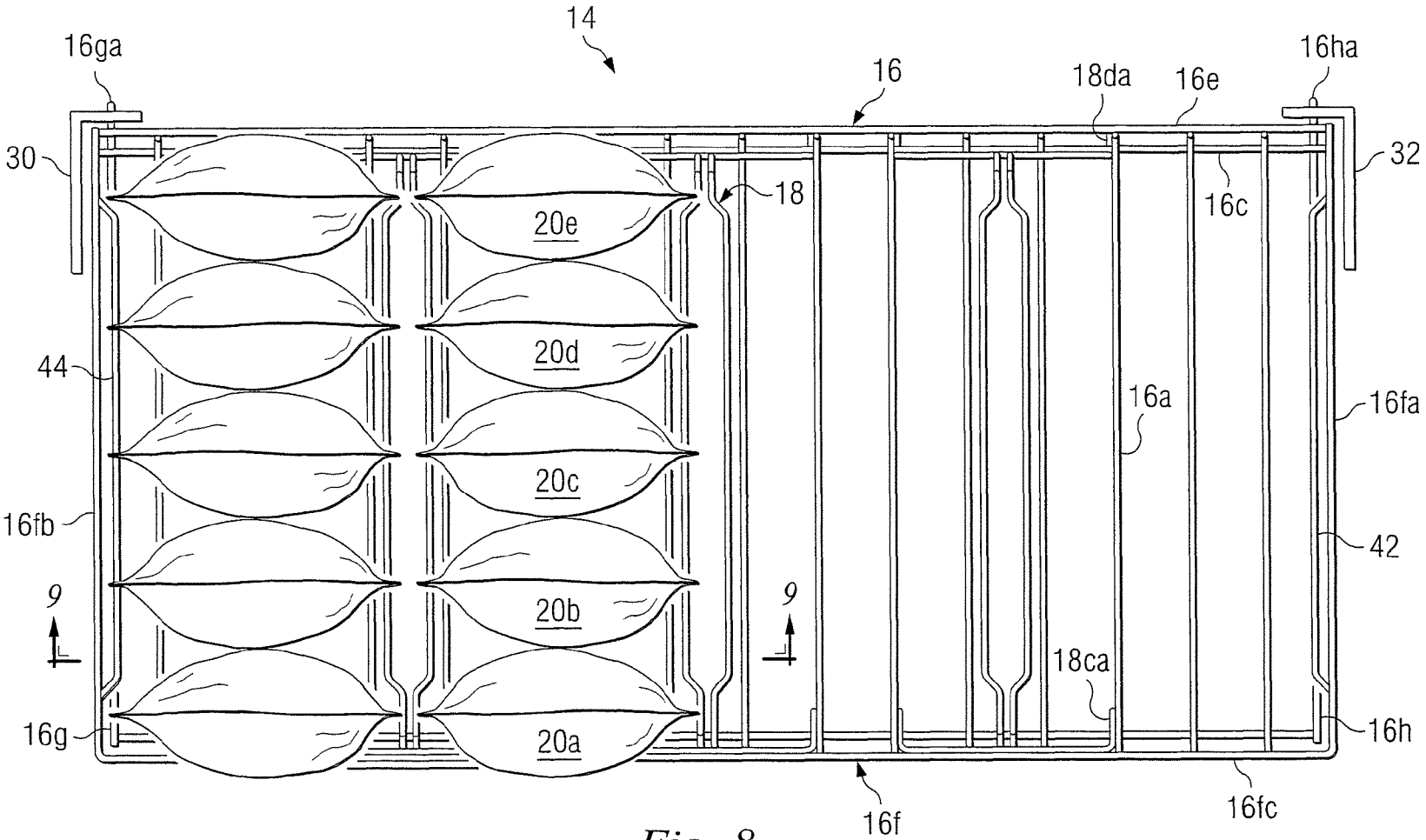
FIG. 8 is top plan view of the tier illustrated in FIG. 6.

The tiers 14 are representatively illustrated in FIGS. 2 and 8 as being removably coupled to the support structure 12 by inserting the protrusions 16*ga* and 16*ha* into the holes 34 at the height at which each tier 14 is desired to hang. The engagement of the protrusions 16*ga* and 16*ha* with the holes 34 creates pivot points on the uprights 30 and 32, respectively, while the interaction between the support members 16*g* and 16*h* and the front faces of the uprights 30 and 32, respectively, maintains the tier 14 at the desired angle with the uprights 30 and 32.

Referring now to FIGS. 1-9, in operation the gravity feed system 10 displays and dispenses inventory packaged in the flex bags 20. The gravity feed system 10 receives the flex bags 20 at the rear of each tier 14 and gravity feeds the flex bags 20 toward the front of each tier 14. The progress of each flex bag 20 is halted by contact with either the vertical front sections 16*ab* of the base unit 16 or an adjacent flex bag 20.

Referring specifically to FIGS. 6-9, when a forward-most flex bag 20*a* is removed from the tier 14, flex bags 20*b*-20*e* are gravity-fed along the channel 50, urged forward and downward by the force of their own weight. The movement of the flex bags 20*b*-20*e* along the channel 50 creates space between the rear-most flex bag 20*e* and the rear of the base unit 16, and that space continues to increase with the sequential removal of flex bags 20*b*-20*e* from the tier 14. When the stock of the gravity feed system 10 is depleted—either entirely or to a level that prompts the user to replenish it—the gravity feed system 10 is restocked by rotating the gravity feed system 10 such that the rear of each tier 14 is accessible and additional flex bags 20 can be added to the rear of each channel 50 of each tier 14.

Referring to FIGS. 5 and 7-9, for a particular channel 50, each flex bag 20 is loaded into the channel 50 by inserting the flex bag 20 into the loading zone 50*a* so that the base 54 contacts the members 16*a* of the base unit 16. The base 54 is allowed to pass between the dividers 18 and the flex bag 20 is seated in the loading zone 50*a* due to the width X of the loading zone 50*a* being at least as great as the width A of the base 54 of the flex bag 20.

If the rearward-most flex bag 20 is released and is not immediately adjacent another flex bag 20 within the channel 50, the rearward-most flex bag 20 is gravity fed toward the front of the tier 14. The flex bag 20 is funneled into the retention zone 50*b* by the geometry of the dividers 18 or, depending on which channel 50 is considered, the geometry of either of the retaining members 42 and 44 and the adjacent divider 18. As previously described herein, the retention zone 50*b* has the width Y that is no greater than the maximum width B of the body 56 of the flex bag 20 and is less than the width A of the base 54 of the flex bag 20. Thus, while the flex bag 20 remains in the retention zone 50*b* the flex bag 20 cannot be removed from the channel 50 by the application of an upward force without distorting the base 54 or rotating the flex bag 20 to clear the dividers 18. Distortion of the base 54 is resisted by the rigidity of the base 54 and rotation of the flex bag 20 is inhibited by the slope of the base unit 16, which urges the base 54 of the flex bag 20 to remain perpendicular to the members 16*a*. The dividers 18 also maintain the flex bag 20 in a substantially upright position while the flex bag 20 is in the retention zone 50*b*, as the flex bag 20 cannot fall forward or backward into a substantially horizontal position due to the lack of clearance between the top 52 of the flex bag 20 and the dividers 18.

As the majority of conventional shelving units are placed so as to be backed by a wall or other display units and the removal of any of the flex bags 20 directly from the retention zone 50*c* is inhibited as detailed above, the removal of any of the flex bags 20 from the tier 14 entails the movement of the flex bag 20 toward the front of the tier 14 and into the dispensing zone 50*c*. Accordingly, the flex bag 20 is gravity fed from the retention zone 50*b* into the dispensing zone 50*c*, which has the width X that is at least as great as the width A of the base 54. At this point the flex bag 20 can be easily removed from the channel 50 and the tier 14, allowing the trailing flex bags 20 to feed further along the channel 50 toward the front of the tier 14.

Standard retail inventory practice entails the cycling of inventory so that units that have been in inventory for longer periods are sold before those units that have been more recently added to inventory. In order to put this practice into effect, many retailers will remove older inventory from a display, place newer inventory near the rear of the display, and replace the older inventory on the display near the forefront. Such a practice requires that time and effort be spent in relocating older inventory in addition to stocking newer inventory.

Retailers also prefer that displays allow for effective presentation of products, such that the product is visible to consumers and easily identifiable. Thus, in the case of products marketed in packaging similar to the flex bag 20, it is desired that the product remain upright within the display. Where, as in the case of the flex bag 20, the shape of the product packaging does not provide support sufficient to maintain the product in an upright position, the product is kept upright by packing it into the display shelf with other products so that the products interact with one another to maintain each other in an upright position. The support for the upright orientation of the product diminishes, however, with the removal of the first and every subsequent product, until insufficient support exists to maintain the product in an upright position and the product falls over.

The spatial relationship and interaction between the flex bags 20 and the channel 50 maintains the flex bags 20 in the most desirable display position (i.e. generally upright) while also ensuring proper cycling of inventory. The apparatus described above encourages and facilitates such cycling of inventory by providing a means by which the flex bags 20 are dispensed in the order in which they are added to the gravity feed system 10 inventory. Moreover, the gravity feed system 10 eliminates the repetitious handling of products that is currently inherent to most inventory cycling practices.

Figure 10:
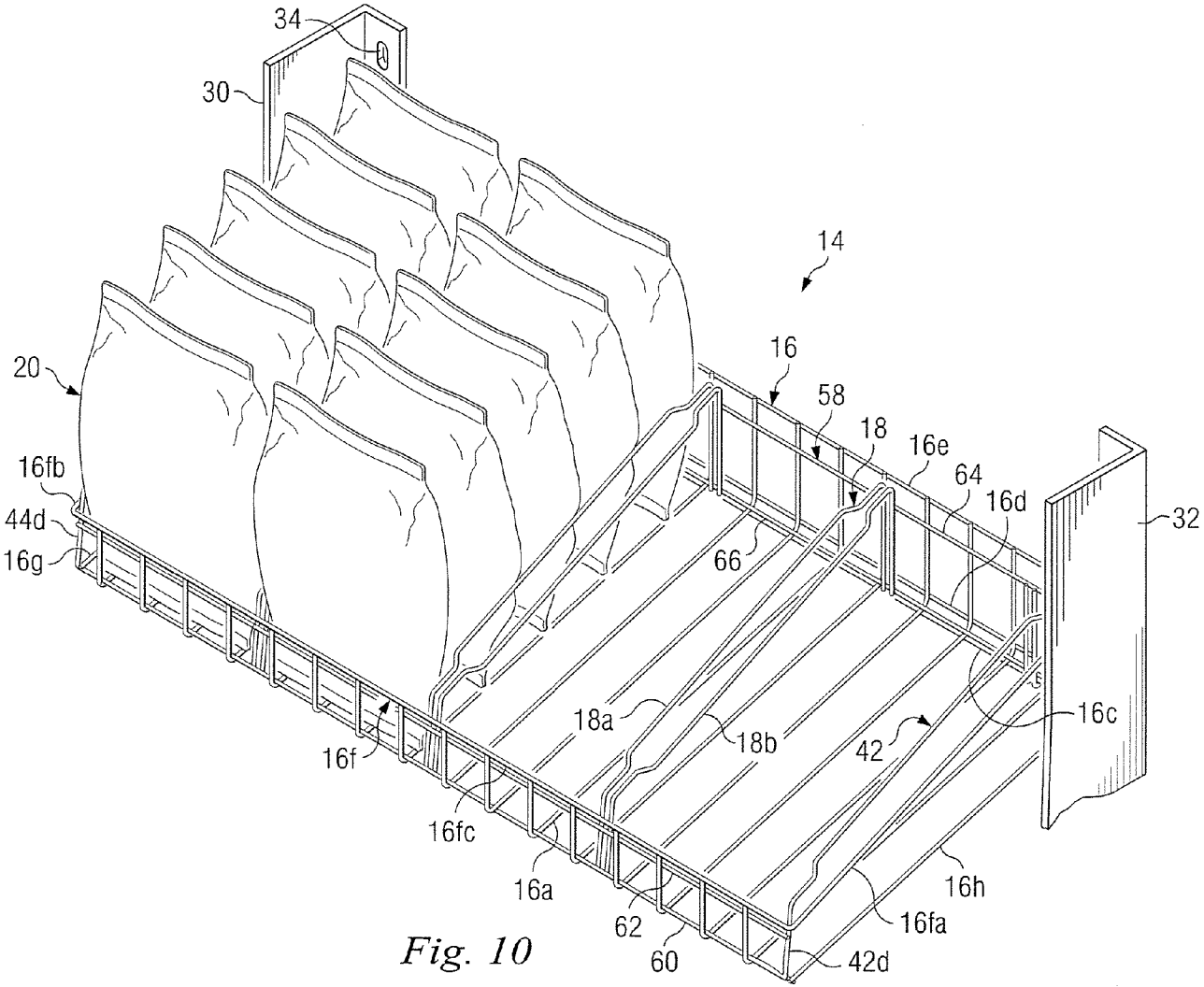
FIG. 10 is a perspective view of an alternative embodiment of one of the tiers illustrated in FIG. 1.
Figure 11:
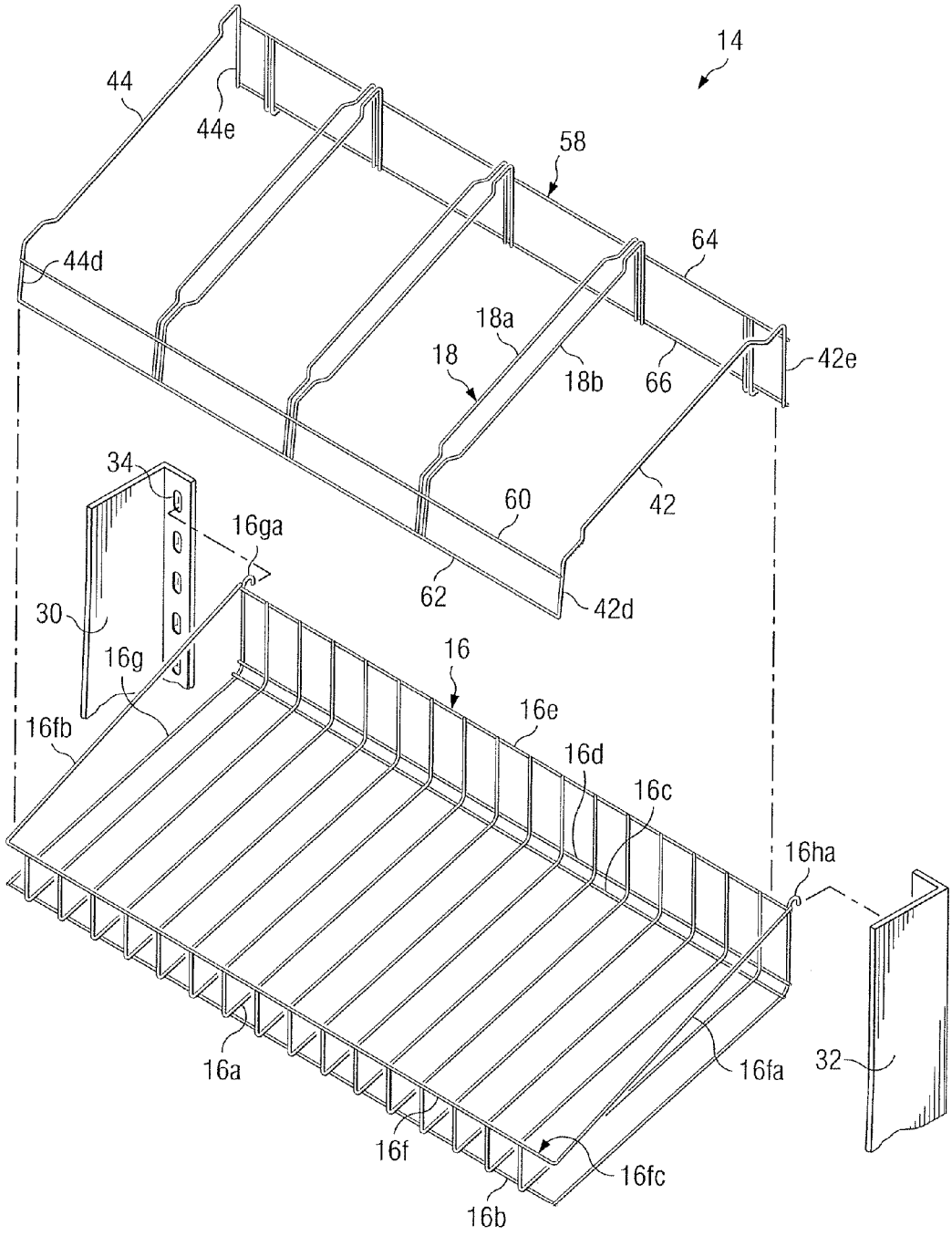
FIG. 11 is an exploded perspective view of the alternative tier embodiment shown in FIG. 10.

Referring to FIGS. 10 and 11, in some alternative embodiments the individually installed dividers 18 and retaining members 42 and 44 that are attached to the base unit 16 are replaced by a channel insert 58. In such embodiments, the dividers 18 and retaining members 42 and 44 are integral and fixed features of the channel insert 58, which is installed in the tier 14 by simply placing the channel insert 58 within the base unit 16. The dividing members 18*a* and 18*b* are configured and spaced as described in the exemplary embodiments detailed previously but lack the divider bases 18*c* and 18*d* shown in FIGS. 3-5. The retaining members 42 and 44 are not connected to the base unit 16 in such embodiments and include front and rear sections 42*d* and 42*e* and 44*d* and 44*e*, respectively, which approximate the shape and size of the front sections 18*ab* and 18*bb* and the rear sections 18*ac* and 18*bc*, respectively of the dividers 18. The dividers 18 are connected to cross-members 60, 62, 64, and 66, which extend horizontally along the lateral length of the base unit 16 at the front-bottom, front-top, rear-top and rear-bottom positions, respectively, and join the dividers 18 and the retaining members 42 and 44. In some such embodiments, the channel insert 58 is initially configured with consideration of the known physical characteristics (as previously described) of the inventory to be displayed in and dispensed from the gravity feed system 10.

An apparatus for storing and dispensing containers has been described that includes a tier comprising a base unit comprising a bottom portion opposite front and rear portions; opposite side portions; and a channel that extends along and above a top side of the bottom portion, the channel having rear and front sections respectively configured to receive and dispense containers and a narrowed intermediate section disposed between the front and rear sections and configured to restrain upward removal of the containers. In some exemplary embodiments, the containers have flexible constructions and the channel is configured so that a base of one of the containers may travel substantially unimpeded from the rear portion toward the front portion while a midsection of the container is compressed or narrows to substantially match the contour of the channel and the container is secured against movement in a substantially vertical direction. In some exemplary embodiments, the channel is a first channel and the tier comprises at least one other channel. In some exemplary embodiments, the channel is defined by a dividing structure secured to the base unit and one of the side portions. In some exemplary embodiments, the channel extends through first and second dividing structures secured to the base unit. In some such exemplary embodiments, at least one of the first dividing structure and the second dividing structure is integral to the base unit. In some such exemplary embodiments, at least one of the dividing structures comprises a bevel configured to direct the containers from the rear section into the intermediate section. In some such exemplary embodiments, at least one of the dividing structures comprises a bevel configured to gradually widen the channel in transition from the intermediate section to the front section. In some such exemplary embodiments, at least one of the dividing structures is adapted to be removably coupled with the base unit so that the dividing structure can be installed at a plurality of locations along the base unit. In some such exemplary embodiments, the dividing structures are of wire construction. In some such exemplary embodiments, the dividing structures are of plastic construction. In some such exemplary embodiments, the dividing structures substantially parallel the bottom portion of the base unit. In some such exemplary embodiments, both of the first and second dividing structures are adapted to be removable from the base unit and are interconnected. In some such exemplary embodiments, at least one of the first and second dividing structures includes a friction-reducing coating. In some such exemplary embodiments, the friction-reducing coating contains Teflon. In some such exemplary embodiments, the friction-reducing coating is a Sliptex product manufactured by Prism Powder Coating Ltd. In some exemplary embodiments, the channel is a first channel and the tier comprises at least one other channel. In some such exemplary embodiments, the at least one other channel is defined by one of the first dividing structure and the second dividing structure in combination with one of one of the side portions of the base unit and an additional dividing structure. In some exemplary embodiments, the tier is coupled with a support structure. In some such exemplary embodiments, the tier is removably coupled with the support structure and the support structure is configured to receive the tier at a plurality of locations within the support structure. In some such exemplary embodiments, at least one of the tier and the support structure is configured so that the bottom portion of the base unit is forwardly and downwardly sloped when the tier is coupled with the support structure. In some such exemplary embodiments, the tier is a first tier and the apparatus comprises at least one other tier that is removably coupled with the support structure. In some such exemplary embodiments, the support structure is configured to receive the at least one other tier at a plurality of locations. In some exemplary embodiments, the base unit is of lattice wire construction. In some exemplary embodiments, the base unit is of plastic construction. In some exemplary embodiments, at least one of the bottom, front, rear, and side portions comprises a solid panel. In some exemplary embodiments, the base unit includes a friction-reducing coating. In some such exemplary embodiments, the friction-reducing coating contains Teflon. In some such exemplary embodiments, the friction-reducing coating is a Sliptex product manufactured by Prism Powder Coating Ltd.

A method of constructing an apparatus for storing and dispensing containers is described and comprises the steps of providing a base unit comprising a bottom portion, front and rear portions, and opposite side portions; and forming a channel within the base unit, said channel extending substantially between the rear portion and the front portion and having a narrowed intermediate portion disposed between the rear and front portions. In some exemplary embodiments, the method further comprises the steps of providing a support structure and removably coupling the base unit with the support structure. In some such exemplary embodiments, the method further comprises the step of configuring the support structure to receive the base unit in a plurality of locations on the support structure. In some such exemplary embodiments, the method further comprises the step of configuring at least one of the base unit and the support structure so that the bottom portion of the base unit has a forwardly and downwardly sloped orientation when the base unit is coupled with the support structure. In some exemplary embodiments, the method further comprises the step of configuring a lateral cross-section of the channel so that there is sufficient clearance between the bottom portion of the base unit and a narrowed portion of the cross-section to allow a base of a container to travel substantially unimpeded along the channel while a narrowed or compressible midsection of the container is disposed within the narrowed portion of the cross-section and the container is secured against movement in a substantially vertical direction. In some exemplary embodiments, the method further comprises the step of forming the channel within the base unit is performed by providing a dividing structure that removably couples with the base unit. In some such exemplary embodiments, the method further comprises the step of configuring the base unit to receive the dividing structure at a plurality of locations. In some such exemplary embodiments, the method further comprises the step of treating the dividing structure with a friction-reducing coating. In some such exemplary embodiments, the treating step is performed using a friction-reducing coating containing Teflon. In some such exemplary embodiments, the treating step is performed using a friction-reducing Sliptex coating product manufactured by Prism Powder Coating Ltd.

A gravity feed shelving apparatus for storing and dispensing flexible containers such as flex bags is described and comprises a support structure having a vertically extending portion; and a vertically spaced plurality of tier portions supported on the vertically extending support structure portion, each supported tier portion having a base unit with opposite front and rear portions, a forwardly and downwardly sloping bottom portion, opposite side portions, and a plurality of side-by-side channels extending in front-to-rear directions with each channel being at least partially defined by one of a plurality of dividing structures secured to the base unit, each channel having rear and front sections respectively configured to receive and dispense flex bags, and a narrowed intermediate section disposed between the rear and front sections and being configured to engage and narrow portions of flex bags received therein and restrain upward removal of the received flex bags therefrom. In some exemplary embodiments, the dividing structures include bevels configured to guide received flex bags into the intermediate section of the channel. In some exemplary embodiments, the dividing structures are treated with a friction-reducing coating. In some exemplary embodiments, at least one of the dividing structures is removably secured to the base unit. In some exemplary embodiments, the base unit is configured to receive the at least one removably secured dividing structure at a plurality of locations on the base unit. In some exemplary embodiments, the base unit is of latticed metal construction. In some exemplary embodiments, the base unit is treated with a friction-reducing coating.

It is understood that variations may be made in the foregoing without departing from the scope of the disclosure.

Any spatial references such as, for example, "upper," "lower," "above," "below," "between," "vertical," "horizontal," "angular," "upward," "downward," "side-to-side," "left-to-right," "right-to-left," "top-to-bottom," "bottom-to-top," "top," "bottom," etc., are for the purpose of illustration only and do not limit the specific orientation or location of the structure described above.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. An apparatus for storing and dispensing containers, the apparatus comprising a tier, the tier comprising:

a base unit horizontally spaced first and second dividing structures connected to the base unit, the first and second dividing structures comprising first and second dividing members, respectively, each of the first and second dividing members comprising:

a generally vertical front section;

a generally vertical back section; and an intermediate section extending between the vertical front section and the vertical back section; and a channel defined between the first and second dividing members, the channel having forward and rearward end portions and extending therebetween in a first direction, the channel comprising:

a first zone configured to receive the containers, the first zone:

extending in the first direction between the rearward end portion and the respective intermediate sections of the first and second dividing members; and extending in a second direction between the respective vertical back sections of the first and second dividing members, the second direction being generally perpendicular to the first direction;

wherein the first zone defines a first distance in the second direction between the respective vertical back sections of the first and second dividing members;

a second zone configured to dispense the containers, the second zone:

extending in the first direction between the forward end portion and the respective intermediate sections of the first and second dividing members;

extending in the second direction between the respective vertical front sections of the first and second dividing members;

wherein the second zone defines a second distance in the second direction between the respective vertical front sections of the first and second dividing members; and a third zone configured to restrain upward removal of the containers, the third zone:

extending in the first direction between the first and second zones and along the respective intermediate sections of the first and second dividing members; and extending in the second direction between the respective intermediate sections of the first and second dividing members;

wherein, at any point along either of the respective intermediate sections of the first and second dividing members, the third zone defines a third distance in the second direction between the respective intermediate sections of the first and second dividing members; and wherein the third distance is less than each of the first distance and the second distance.

2. The apparatus of claim 1, wherein each of the first and second dividing members further comprises:

a rear bevel extending between the intermediate section and the vertical back section; and a front bevel extending between the intermediate section and the vertical front section;

wherein the respective rear bevels of the first and second dividing members narrow the spacing between the first and second dividing members from the first distance to the third distance; and wherein the respective front bevels of the first and second dividing members widen the spacing between the first and second dividing members from the third distance to the second distance.

3. The apparatus of claim 2, wherein the respective rear bevels of the first and second dividing members are configured to direct the containers from the first zone into the third zone.

4. The apparatus of claim 3, wherein the respective front bevels of the first and second dividing members are configured to direct the containers from the third zone to the second zone.

5. The apparatus of claim 1, wherein the first dividing structure further comprises:

a third dividing member spaced from the first dividing member, the third dividing member comprising a generally vertical front section, a generally vertical back section, and an intermediate section extending between the vertical front section and the vertical back section;

wherein a first spacing is defined between the respective vertical front sections of the first and third dividing members of the first dividing structure;

wherein a second spacing is defined between the respective vertical back sections of the first and third dividing members of the first dividing structure;

wherein a third spacing is defined between the respective intermediate sections of the first and third dividing members of the first dividing structure;

wherein the third spacing is greater than each of the first and second spacings; and wherein the respective intermediate sections of the first and third dividing members of the first dividing structure are spaced by the third spacing at any point along either of the respective intermediate sections of the first and third dividing members of the first dividing structure.

6. The apparatus of claim 5, wherein the second dividing structure further comprises:

a fourth dividing member spaced from the second dividing member, the fourth dividing member comprising a generally vertical front section, a generally vertical back section, and an intermediate section extending between the vertical front section and the vertical back section;

wherein a fourth spacing is defined between the respective vertical front sections of the second and fourth dividing members of the second dividing structure;

wherein a fifth spacing is defined between the respective vertical back sections of the second and fourth dividing members of the second dividing structure;

wherein a sixth spacing is defined between the respective intermediate sections of the second and fourth dividing members of the second dividing structure;

wherein the sixth spacing is greater than each of the fourth and fifth spacings; and wherein the respective intermediate sections of the second and fourth dividing members of the second dividing structure are spaced by the sixth spacing at any point along either of the respective intermediate sections of the second and fourth dividing members of the second dividing structure.

7. The apparatus of claim 1, wherein at least one of the first dividing structure and the second dividing structure is integral to the base unit.

8. The apparatus of claim 1, wherein at least one of the first and second dividing structures is adapted to be removably coupled with the base unit so that the at least one of the first and second dividing structures can be installed at a plurality of locations along the base unit.

9. The apparatus of claim 1, wherein the first and second dividing structures are of wire construction.

10. The apparatus of claim 1, wherein the first and second dividing structures are of plastic construction.

11. The apparatus of claim 1, wherein at least one of the first and second dividing structures comprises a friction-reducing coating.

12. The apparatus of claim 1, wherein both of the first and second dividing structures are adapted to be removable from the base unit and are interconnected.

13. The apparatus of claim 1, wherein the tier is coupled with a support structure.

14. The apparatus of claim 13, wherein the tier is removably coupled with the support structure and the support structure is configured to receive the tier at a plurality of locations within the support structure.

15. The apparatus of claim 13, wherein at least one of the tier and the support structure is configured so that a bottom portion of the base unit is forwardly and downwardly sloped when the tier is coupled with the support structure.

16. The apparatus of claim 13, wherein the tier is a first tier and the apparatus comprises at least one other tier that is removably coupled with the support structure.

17. The apparatus of claim 16, wherein the support structure is configured to receive the at least one other tier at a plurality of locations.

18. The apparatus of claim 1, wherein the base unit is of lattice wire construction.

19. The apparatus of claim 1, wherein the base unit is of plastic construction.

20. The apparatus of claim 1, wherein the base unit comprises a friction-reducing coating.

21. A gravity feed shelving apparatus for storing and dispensing flexible containers, comprising:

a support structure having a vertically extending portion; and a vertically spaced plurality of tier portions supported on the vertically extending support structure portion, each supported tier portion comprising:

a base unit first and second dividing structures secured to the base unit, each of the first and second dividing structures comprising:

a spaced pair of first and second dividing members, each of the first and second dividing members comprising:

a generally vertical front section, wherein a first spacing is defined between the respective vertical front sections of the first and second dividing members;

a generally vertical back section, wherein a second spacing is defined between the respective vertical back sections of the first and second dividing members; and a sloping section extending between the vertical front and back sections, wherein a third spacing is defined between the respective sloping sections of the first and second dividing members, wherein the third spacing is greater than each of the first and second spacings, and wherein the respective sloping sections are spaced by the third spacing at any point along either of the respective sloping sections; and a channel at least partially defined by the first and second dividing structures secured to the base unit, each channel having rear and front portions respectively configured to receive and dispense the flexible containers, and a narrowed intermediate portion disposed between the rear and front portions and being configured to engage and narrow portions of the flexible containers received therein and restrain upward removal of the flexible containers therefrom.

22. The apparatus of claim 21, wherein each of the first and second dividing members further comprises:

a front bevel extending between the sloping section and the vertical front section; and a rear bevel extending between the sloping section and the vertical back section;

wherein the respective front bevels of the first and second dividing members narrow the spacing between the first and second dividing members from the third spacing to the first spacing; and wherein the respective rear bevels of the first and second dividing members narrow the spacing between the first and second dividing members from the third spacing to the second spacing.

23. The apparatus of claim 21, wherein the first and second dividing structures are treated with a friction-reducing coating.

24. The apparatus of claim 21, wherein at least one of the first and second dividing structures is removably secured to the base unit.

25. The apparatus of claim 24, wherein the base unit is configured to receive the at least one of the first and second dividing structures at a plurality of locations on the base unit.

26. The apparatus of claim 21, wherein the base unit is of lattice metal construction.

27. The apparatus of claim 21, wherein the base unit is treated with a friction-reducing coating.

28. The apparatus of claim 21, wherein the channel has forward and rearward ends and extends therebetween in a first direction;

wherein the rear portion of the channel:

extends in the first direction between the rearward end and the respective sloping sections of the second dividing member of the first dividing structure and the first dividing member of the second dividing structure; and extends in a second direction between the vertical back section of the second dividing member of the first dividing structure and the vertical back section of the first dividing member of the second dividing structure, the second direction being generally perpendicular to the first direction;

wherein the rear portion defines a first distance in the second direction between the vertical back section of the second dividing member of the first dividing structure and the vertical back section of the first dividing member of the second dividing structure;

wherein the narrowed intermediate portion of the channel:

extends in the first direction along the respective sloping sections of the second dividing member of the first dividing structure and the first dividing member of the second dividing structure; and extends in the second direction between the sloping section of the second dividing member of the first dividing structure and the sloping section of the first dividing member of the second dividing structure;

wherein, at any point along either of the respective sloping sections of the second dividing member of the first dividing structure and the first dividing member of the second dividing structure, the narrowed intermediate portion of the channel defines a second distance in the second direction between the sloping section of the second dividing member of the first dividing structure and the sloping section of the first dividing member of the second dividing structure;

wherein the second distance is less than the first distance;

wherein the front portion of the channel:

extends in the first direction between the forward end and the respective sloping sections of the second dividing member of the first dividing structure and the first dividing member of the second dividing structure;

extends in the second direction between the front bevel of the second dividing member of the first dividing structure and the front bevel of the first dividing member of the second dividing structure; and extends in the second direction between the vertical front section of the second dividing member of the first dividing structure and the vertical front section of the first dividing member of the second dividing structure;

wherein the front portion of the channel defines a third distance in the second direction between the vertical front section of the second dividing member of the first dividing structure and the vertical front section of the first dividing member of the second dividing structure; and wherein the third distance is greater than the second distance.

29. An apparatus for storing and dispensing containers, the apparatus comprising a tier, the tier comprising:

a base unit;

first and second dividing structures connected to the base unit, each of the first and second dividing structures comprising:

a spaced pair of first and second dividing members, each of the first and second dividing members comprising:

a generally vertical front section, wherein a first spacing is defined between the respective vertical front sections of the first and second dividing members;

a generally vertical back section, wherein a second spacing is defined between the respective vertical back sections of the first and second dividing members;

an intermediate section extending between the vertical front and back sections, wherein a third spacing is defined between the respective intermediate sections of the first and second dividing members, wherein the third spacing is greater than each of the first and second spacings, and wherein the respective intermediate sections are spaced by the third spacing at any point along either of the respective intermediate sections;

a front bevel extending between the intermediate section and the vertical front section, wherein the front bevel narrows the spacing between the first and second dividing members from the third spacing to the first spacing; and a rear bevel extending between the intermediate section and the vertical back section, wherein the rear bevel narrows the spacing between the first and second dividing members from the third spacing to the second spacing; and a channel defined between the second dividing member of the first dividing structure and the first dividing member of the second dividing structure, the channel having forward and rearward end portions and extending therebetween in a first direction, the channel comprising:

a first zone:

extending in the first direction between the rearward end portion and the respective intermediate sections of the second dividing member of the first dividing structure and the first dividing member of the second dividing structure;

extending in a second direction between the vertical back section of the second dividing member of the first dividing structure and the vertical back section of the first dividing member of the second dividing structure, the second direction being generally perpendicular to the first direction, and extending in the second direction between the rear bevel of the second dividing member of the first dividing structure and the rear bevel of the first dividing member of the second dividing structure, wherein the first zone defines a first distance in the second direction between the vertical back section of the second dividing member of the first dividing structure and the vertical back section of the first dividing member of the second dividing structure;

a second zone:

extending in the first direction along the respective intermediate sections of the second dividing member of the first dividing structure and the first dividing member of the second dividing structure, and extending in the second direction between the intermediate section of the second dividing member of the first dividing structure and the intermediate section of the first dividing member of the second dividing structure, wherein, at any point along either of the respective intermediate sections of the second dividing member of the first dividing structure and the first dividing member of the second dividing structure, the second zone defines a second distance in the second direction between the intermediate section of the second dividing member of the first dividing structure and the intermediate section of the first dividing member of the second dividing structure, and wherein the second distance is less than the first distance; and a third zone:

extending in the first direction between the forward end portion and the respective intermediate sections of the second dividing member of the first dividing structure and the first dividing member of the second dividing structure, extending in the second direction between the front bevel of the second dividing member of the first dividing structure and the front bevel of the first dividing member of the second dividing structure, and extending in the second direction between the vertical front section of the second dividing member of the first dividing structure and the vertical front section of the first dividing member of the second dividing structure, wherein the third zone defines a third distance in the second direction between the vertical front section of the second dividing member of the first dividing structure and the vertical front section of the first dividing member of the second dividing structure, and wherein the third distance is greater than the second distance.

* * * * *